US005481241A

United States Patent [19]

Caddock, Jr.

[11] Patent Number: 5,481,241

[45] Date of Patent: Jan. 2, 1996

[54] FILM-TYPE HEAT SINK-MOUNTED POWER RESISTOR COMBINATION HAVING ONLY A THIN ENCAPSULANT, AND HAVING AN ENLARGED INTERNAL HEAT SINK

[75] Inventor: Richard E. Caddock, Jr., Winchester, Oreg.

[73] Assignee: Caddock Electronics, Inc., Riverside, Calif.

[21] Appl. No.: 151,430

[22] Filed: Nov. 12, 1993

[51] Int. Cl.[6] ..... H01C 1/08

[52] U.S. Cl. ..... 338/51; 338/275

[58] Field of Search ..... 338/51, 52, 53, 338/57, 275, 314; 324/96

[56] References Cited

U.S. PATENT DOCUMENTS

| | | | |
|---|---|---|---|
| 3,955,169 | 5/1976 | Kerfoot et al. | 338/51 |
| 4,121,153 | 10/1978 | Thornburg | 324/96 |
| 4,613,844 | 9/1986 | Kent et al. | 338/314 |
| 4,719,443 | 1/1988 | Salay | 338/314 |
| 4,866,411 | 9/1989 | Caddock | 338/62 |
| 5,019,893 | 5/1991 | Frank et al. | 357/81 |
| 5,253,944 | 10/1993 | Caddock, Jr. | 338/275 |
| 5,291,178 | 3/1994 | Strief et al. | 338/275 |
| 5,304,977 | 4/1994 | Caddock, Jr. | 338/275 |

OTHER PUBLICATIONS

"Precision Thick Film Chip Resistor Guide," Mini–Systems, Inc., Brochure, 4 pp., North Attleboro, Mass., Oct. 1985.

"ISA–PAN® Präzisionswiderstäande und Widerstands–Netzwere," Isabellenhütte, Isotek (Dist.), 9 pp., Swansea, Mass., Dec. 1990.

"Power Resistors Then Power Resistors *Now*," Caddock Electronics, Inc., Catalog Sheet, Riverside, Calif. 1993.

"Type MP Kool–Pak™ Power Film Resistors," Caddock Electronics, Inc., Catalog Sheet, Riverside, Calif. 1992.

"MP820 and MP821 Kool–Tab® Power Film Resistors," Caddock Electronics, Inc., Catalog Sheet, Riverside, Calif. 1989, 1991, 1992.

*Primary Examiner*—Tu Hoang
*Attorney, Agent, or Firm*—Richard L. Gausewitz

[57] ABSTRACT

A low-cost heat sink-mounted power film resistor having a high power rating for its footprint size, and not incorporating any housing. The resistor is bolted or otherwise secured tightly to an external heat sink in high heat-conduction relationship, the external heat sink being contacted flatwise by a rectangular internal heat sink. The footprint size and shape of the internal heat sink correspond substantially to those of commercially-marketed power film resistors having molded synthetic resin housings. The internal heat sink is bonded in high heat-conductivity relationship to a ceramic chip having a resistive film on the side thereof remote from the heat sink. Over such resistive film is a thin environmental coating. The leads are provided and connected to spaced portions of the film, on metalization pads.

23 Claims, 3 Drawing Sheets

FIG. 1.
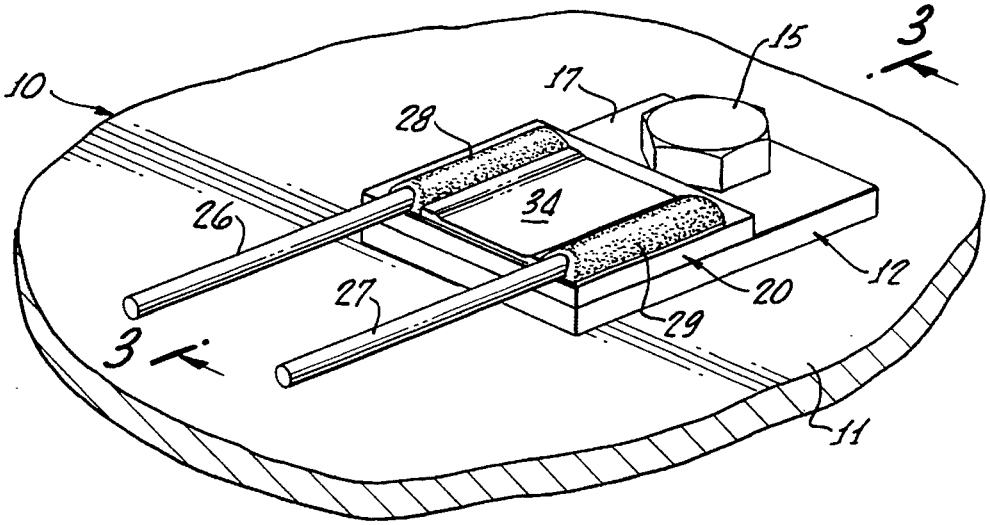
FIG. 2.
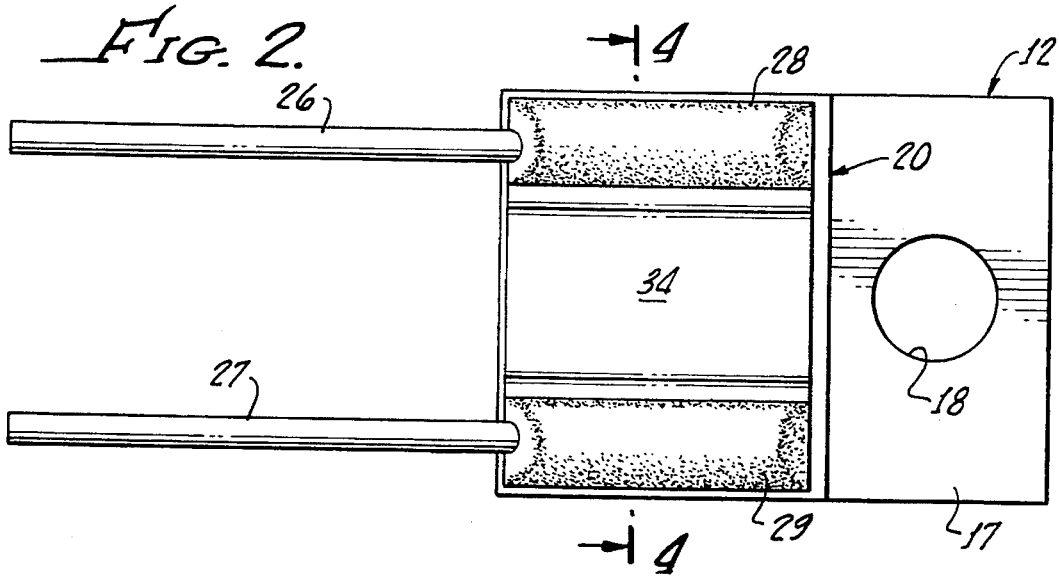
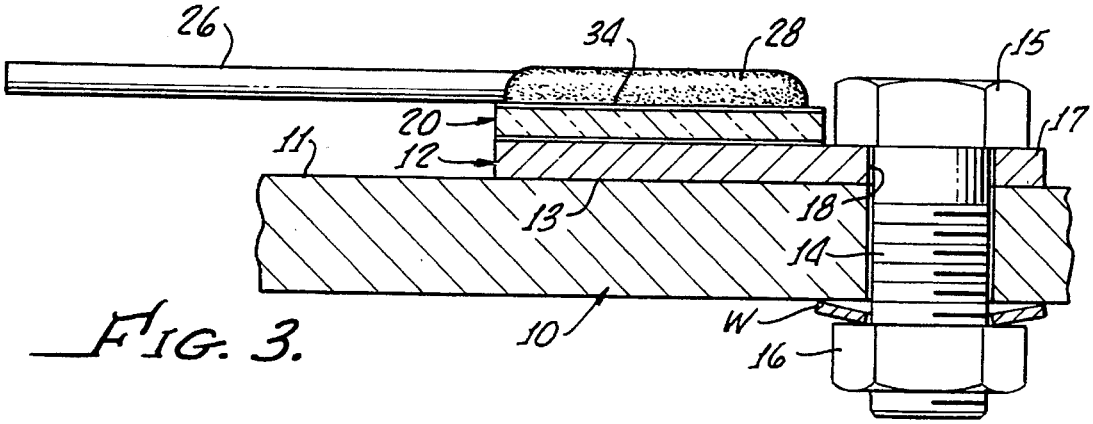
FIG. 3.

FILM-TYPE HEAT SINK-MOUNTED POWER RESISTOR COMBINATION HAVING ONLY A THIN ENCAPSULANT, AND HAVING AN ENLARGED INTERNAL HEAT SINK

BACKGROUND OF THE INVENTION

There are now commercially marketed in the United States heat sink-mountable rectangular film-type power resistors having molded environmentally-protective synthetic resin housings. These resistors have flat lower surfaces that are at least partially formed by portions of such housings. The lower surfaces have predetermined sizes and shapes that are called "footprints" in the industry. These footprints are defined by power package styles such as TO-220 style and TO-126 style as well as others. These power package styles have been used for years for power semiconductor devices and in recent years for power resistor devices. The thermal mounting issues related to transferring heat from these devices, with these footprints, to a metal heat sink or metal chassis are well understood.

It is desired by users of the resistors that the sizes and shapes of the footprints remain the same. This does not mean that there is only one size and shape of rectangular footprint in the industry; it does mean that there are a limited number of footprint sizes and shapes that are in effect standard in the industry.

Reference is made to the 1987 book named D.A.T.A. Power Semiconductors, Edition 21, published by D.A.T.A. Incorporated. This book summarizes the JEDEC registrations (the assignment of a number to each particular package with its associated footprint). Particular reference is made to page 1,021 of such book relative to the above-indicated number TO 220, and to page 1,012 relative to the above-indicated number TO 126. As there specified, the TO 220 has a maximum footprint width of 0.4197 inch, and a maximum footprint length of 0.65 inch. The TO 126 has a maximum footprint width of 0.330 inch, and a maximum footprint length of 0.450 inch. Also as there specified, somewhat smaller footprint widths and lengths are permitted relative to each number. The above-specified maximum footprint sizes are standard in the semiconductor industry in the United States.

SUMMARY OF THE INVENTION

Applicant has now conceived that by omitting the above-indicated housings and instead employing thin flat partial encapsulants over only the resistive films, and by enlarging bonded metal internal heat-sink portions of the resistors so that such internal heat sink portions substantially fill, in each instance, the maximum-size standard footprint specified in the United States semiconductor industry for power semiconductors, a substantially higher power rating is achieved—for a given footprint—and at a lower cost.

There exist various applications where the degree of environmental/dielectric protection provided by the synthetic resin housings is not required. Applicant can now in such applications, with the present combination, increase the power rating per standard footprint size, and can reduce costs by eliminating the substantial expenses incident to the molding of housings.

The present combination comprises an external heat sink, a ceramic chip having a resistive film on the upper side thereof, an internal heat sink bonded to the chip in high heat-transfer relationship, a thin flat environmentally protective coating over the resistive film, and a fastener to secure the internal and external heat sinks to each other. The combination further comprises relatively stiff leads that are bonded to the chip in electrically-connected relationship to spaced-apart portions of the resistive film.

BRIEF DESCRIPTION OF THE DRAWINGS

FIG. 1 is an isometric view of the resistor-external heat sink combination, as secured tightly together by a fastener means illustrated as being a bolt;

FIG. 2 is a top plan view of the finished power film resistor, without the external heat sink;

FIG. 3 is a side elevation thereof, with the external heat sink;

DETAILED DESCRIPTION OF THE PREFERRED EMBODIMENT

Figure 4:
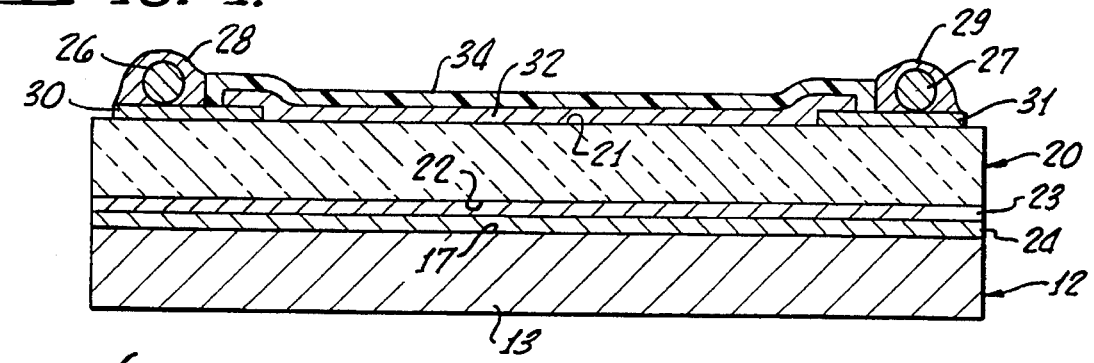
FIG. 4 is a sectional view on line 4—4 of FIG. 2, but not to scale.

The external heat sink is indicated schematically at 10 in FIG. 1, and has a flat upper surface portion 11 upon which the present power resistor is mounted. External heat sink 10 includes various types, such as a metal (typically aluminum) chassis, a circuit board with copper heat sink plane, a specially-formed large metal heat sink, etc.

Mounted on the flat surface portion 11 is an internal heat sink 12, namely a rectangular metal sheet (preferably copper) having sufficient thickness that a fastener secured to one end portion thereof will hold the entire sheet closely against surface 11 in high heat-transfer relationship. Preferably, the thickness of heat sink 12 is 0.055 inch for the specific footprint described below.

The size and shape of internal heat sink 12 are such that the bottom surface 13 (FIG. 3) thereof engages external heat sink surface 11 at substantially an entire maximum standard "footprint" referred to at the beginning of this specification. Thus, for footprint number TO 220, the internal heat sink has a length of 0.640 inch and a width of 0.410 inch. Stated more definitely, the bottom surface 13 of internal heat sink 12 has such length and width, in one embodiment. Furthermore, very preferably, the entire internal heat sink 12 has (in the same embodiment) such length and width in that it is stamped from a sheet of uniform thickness.

The internal heat sink 12 is preferably plated with nickel, both on its top surface 17 and its bottom surface 13 (FIG. 4).

The external and internal heat sinks are secured tightly together, in high heat-transfer relationship, as by a bolt 14 (FIG. 3) having a head 15 above internal heat sink 12, and having a nut 16 that is turned tightly up toward the lower surface of external heat sink 10. Very preferably, a thermal grease is provided between the mating surfaces of the heat sinks. More specifically, the bolt 14 extends through a bolt hole 18 (FIG. 2) that is centered in the above-indicated end portion of internal heat sink 12. A compression washer W is preferably provided between the bolt and the external heat sink, as shown in FIG. 3.

A rectangular ceramic chip or substrate 20 is provided, and has such shape and size as to cover at least the major portion of internal heat sink 12. Chip 20 is electrically insulating, and is caused to be sufficiently thin that it will conduct heat effectively from the below-described resistive film to heat sink 12. The preferred material of chip 20 is aluminum oxide. The preferred thickness of chip 20 is 0.030 inch for specific the footprint described above. For the particular external heat-sink size stated above, the chip 20 has a width of 0.400 inch and length of 0.370 inch.

Chip 20 is preferably formed of aluminum oxide.

Chip or substrate 20 is bonded to internal heat sink 12 in high heat-transfer relationship, and is so located as to cover the heat sink 12 entirely on one side of the transverse center line of such heat sink 12, and over a part of heat sink 12 on the other side of such center line.

Stated more specifically, one edge of chip 20 is registered and coextensive with the end edge of heat sink 12 at the end thereof remote from bolt hole 18. Opposed edges of chip 20, at right angles to such one edge, are registered with side edges of heat sink 12. The remaining edge of chip 20, parallel to such one edge, is on the opposite side of the above-indicated center line.

As in the case of heat sink 12, chip or substrate 20 has upper and lower surfaces that are parallel to each other. These are respectively numbered 21 and 22 (FIG. 4).

The preferred high heat-conduction bond between lower surface 22 of the chip and upper surface 17 of the external heat sink 12 is made by screen printing a metalization layer 23 onto substantially the entire lower surface 22, FIG. 4, and employing a high melting-point solder layer 24 on heat-sink surface 17 and in contact with the entire metalization layer 23. The heat sink-substrate combination is then baked or otherwise heated so as to melt layer 24. Layer 23 is, for example, a palladium silver metalization such as Du Pont 6134, while solder layer 24 is preferably 96.5% tin and 3.5% silver. Alternatively, the solder may be 95% tin and 5% silver.

The combination further comprises elongate parallel leads or terminals 26,27, which extend along the parallel side edge portions of upper surface 21 of chip 20. Preferably, the leads extend substantially all the way to that edge of chip 20 that is adjacent bolt hole 18. The leads 26,27 are stiff wires, and project from the chip in a direction opposite to the direction of a extension of the exposed portion of heat sink 12 from the chip. The projecting portions of the leads 26,27 are self supporting, because of the size (thickness and width) of the lead material, and because of the strength of the below-described bond to chip or substrate 20. The illustrated cylindrical leads 26,27 are 0.032 inch in diameter and are made of solder-coated oxygen-free copper. The cross-sectional shape of the leads may also be square or rectangular.

The bond between chip 20 and the inner ends of the leads is effected by a combination of solder and metalization pads. The solder, which is preferably the high melting-point solder specified above, is applied after the leads (on a lead card or a lead frame, not shown) are held (as by a fixture) in proper location relative to chip 20. More specifically, the lead ends, while held on the chip, are soldered thereto by using a soldering iron. The solder is shown at 28,29.

The above-stated bonding of the leads to the chip is preferably effected after the described bonding of the chip to internal heat sink 12. Furthermore, it is effected while the chips are in discrete or individual condition, not part of any chip array. The below-described steps, on the other hand, are preferably effected while numerous chips or substrates 20 are part of a chip array, being oriented in horizontal and vertical rows. A single sheet of the ceramic is laser-scribed to create the horizontal and vertical rows, the scribing being such that individual chip elements may be broken apart after completion of the below-stated steps.

Figure 5:
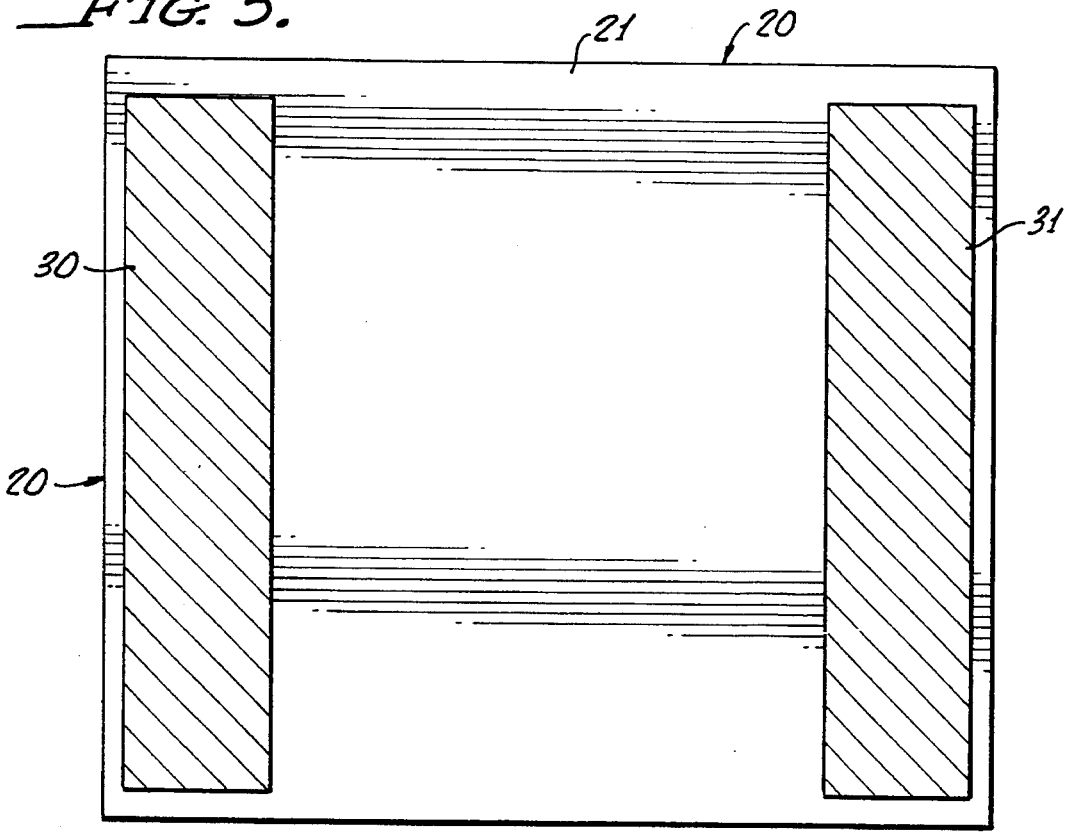
FIG. 5 is a top plan view showing the substrate or chip having metalization pads applied to the upper surface thereof.
Figure 6:
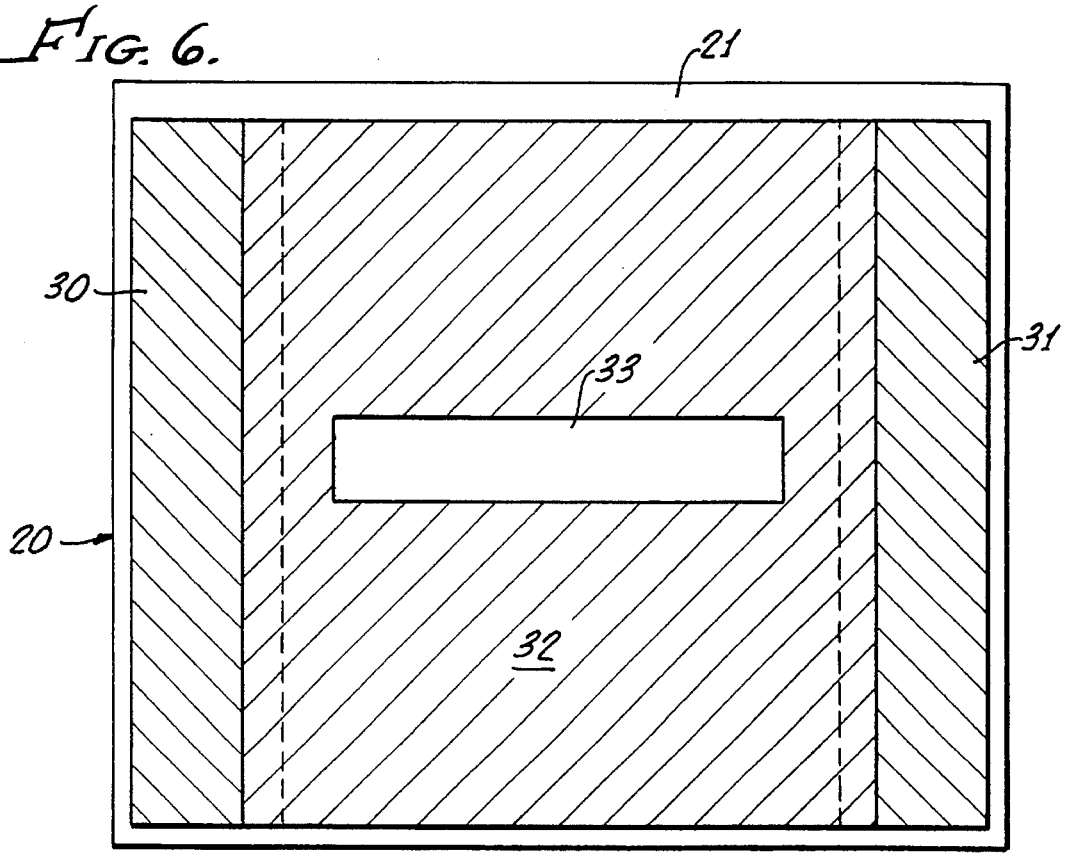
FIG. 6 is a view corresponding to FIG. 5, but showing a resistive film applied over the substrate and portions of the pads, and further showing a trimming slot.

As above indicated, the connection of the leads 26,27 to each chip 20 is effected by the solder 28,29 and by metalization pads. The latter are shown in FIG. 5, having been applied to the upper surface 21 of chip 20 preferably by screen-printing. The pads are numbered 30 and 31. The pads are composed of the above-indicated palladium silver, preferably, and the chips are fired after application of the pads and prior to the below-stated application of the resistive film. The leads 26,27, when sequentially applied, are fixture-held against and soldered to the chip regions having pads 30,31 thereon. Each pad has a width of 0.080 inch in the specified embodiment.

A resistive film 32 is applied to upper surface 21 of substrate 20, and has opposed edge portions that lap somewhat over the edges of metalization pads 30,31 and are therefore in good electrical contact therewith. The preferred film 32 is solid, that is to say uninterrupted except as below specified, and is preferably thick-film resistive material such as electrically conductive complex metal oxides in a glass matrix. Preferably, the resistive film 32 is applied to the substrate surface 21 by screen-printing. The chips are fired after application of the resistive film.

To trim the resistive film 32 to the desired resistance value, within a desired tolerance range, a slot 33 is laser-cut through such film in a direction perpendicular to the pads 30,31. The laser cutting is continued until the resistance value is as desired. Because slot 33 is perpendicular to the pads, the paths of current flowing through film 32 between such pads are parallel to the slot 33, thus achieving uniform current density.

Figure 7:
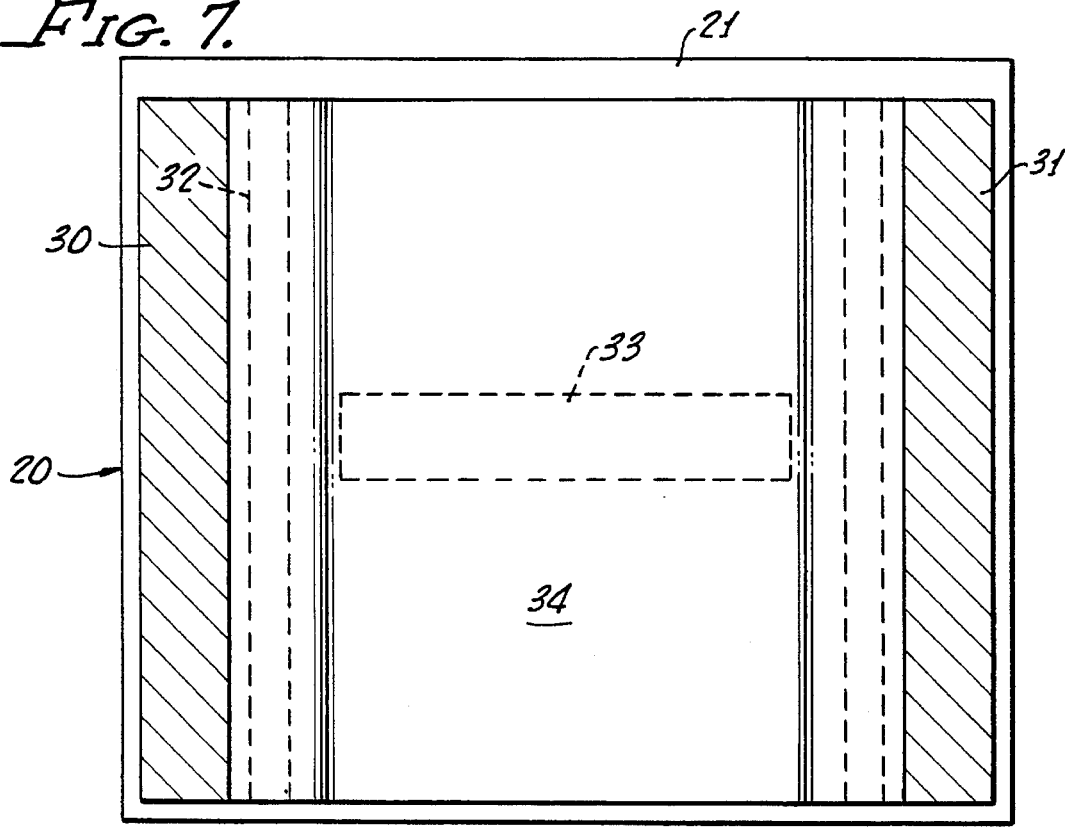
FIG. 7 is a corresponding view showing an environmental coating applied over the construction of FIG. 6.

As above indicated, the combination of the internal heat sink 12, ceramic chip or substrate 20, leads 26,27 and solder 28,29 is not molded in any housing. Instead, there is applied over the resistive film 32—prior to application of the leads, and while the chips are still in an array—a thin flat layer 34, FIG. 7, of environmentally protective (and electrically insulating) material. This may be termed a thin environmental coating or encapsulant, and is deposited directly over the resistor deposit 32. The deposition of this thin encapsulant is preferably by screen-printing. It may also be accomplished by stenciling, by selectively depositing a thin layer of material (such as a spray-on coating) through a mask, by sputtering a coating through a mask, or by ink-jet spraying of a coating that is selectively deposited using no mask. Another manner of application is to coat the entire chip or substrate and then etch (or otherwise selectively remove) the encapsulating material from the pads 30,31 that are employed to aid in the bonding of the leads to the chip and that are employed to electrically connect the leads to the edges of the resistive film.

There will now be stated more fully one manner of applying the thin environmental layer or coating on those occasions when the preferred screen-printing is not employed. A relatively thin conformal layer is applied in order to cover the resistive film. Such conformal layer may also incidentally cover only a portion or only portions of those lead ends that are adjacent such film. "Relatively thin", as used in this patent application, means not as thin as a screen-printed coating, but not nearly as thick as would be a mound of encapsulating material (hypothetical) which entirely encapsulates those lead ends that are adjacent the resistive film and are within the perimeter of the ceramic chip or substrate. The conformal is applied, for example, by syringes or by a bank of ink-jet nozzles.

The preferred material forming the environmentally protective layer 34, and which is deposited by screen-printing as is preferred, is a screen-printable polymer. One example of this is ESL 240-SB, manufactured by Electro Science Laboratories, Inc. of King of Prussia, Pa.

The environmentally protective layer 34 is cured by heating the chip array. In addition to providing the stated advantages, layer 37 tends to passivate the resistive film 32 during subsequent processing operations such as those involving flux which is employed during the soldering.

Figure 8:
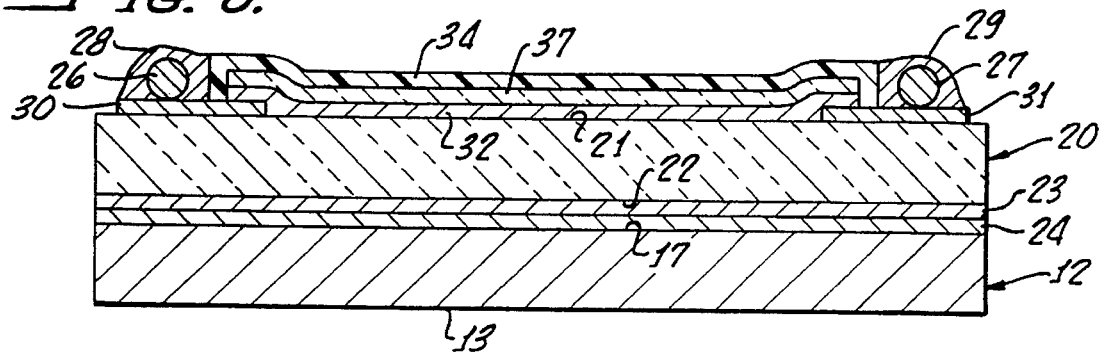
FIG. 8 is a sectional view corresponding to FIG. 4, and also not to scale, but showing a second environmental coating over the resistive film.

Referring next to FIG. 8, the environmentally protective layer may, alternatively or additionally relative to the layer 34, comprise a glass layer 32 that is suitably applied to the resistive film following which the chips are fired. The preferred manner of application of glass layer 32 is screen-printing. In those cases where glass is employed together with polymer encapsulant, the glass is between the resistive film and the polymer.

There has thus been described a combination which has a relatively low manufacturing cost in that no molded housing is provided, and has a high power rating for its size in that the internal heat sink 12 occupies substantially the entire footprint previously "occupied" by prior-art film-type power resistors, the lower surfaces of the latter having been formed of synthetic resin at least in part. The cost of the increased copper is more than compensated by savings achieved relative to the cost of molds, the cost of molding material, the labor incident to molding, etc. Thus, the present resistor combination, notably including the combination with the external heat sink 10 effected by the bolt 14 or other connector or fastener means, is highly desirable.

The foregoing detailed description is to be clearly understood as given by way of illustration and example only, the spirit and scope of this invention being limited solely by the appended claims.

What is claimed is:

1. A heat sink-mounted power film resistor combination, which comprises:

(a) a flat heat-conductive electrically-insulating substrate having upper and lower surfaces that are parallel to each other, and that are close to each other for effective conduction of heat through said substrate from said upper surface to said lower surface, (b) a resistive film provided on said upper surface, (c) thin environmentally-protective coating means provided on said upper surface over said resistive film, (d) first and second relatively stiff leads respectively mechanically connected to different portions of said upper surface of said substrate, and respectively electrically connected to different portions of said resistive film, said leads being spaced from each other, said different portions of said resistive film being spaced from each other, (e) an internal metal heat sink having upper and lower surfaces that are parallel to each other, (f) means to bond said lower surface of said substrate to said upper surface of said internal metal heat sink in heat-transfer relationship, (g) an external heat sink having a flat surface portion, and (h) means to secure said lower surface of said internal heat sink to said flat surface portion of said external heat sink in heat-transfer relationship, characterized in that there is no molded housing around said substrate, and in that there is no molded housing around said internal heat sink, and in that there is no molded housing around said environmentally-protective coating means.

2. The film resistor combination as claimed in claim 1, in which said substrate is a ceramic.

3. The film resistor combination, as claimed in claim 2, in which said substrate has first and second opposed straight edges that are parallel to each other, and also has third and fourth opposed straight edges that are parallel to each other and are perpendicular to said first and second edges, and in which said internal heat sink has first and second opposed straight edges that are parallel to each other, and also has third and fourth opposed straight edges that are parallel to each other and are perpendicular to said first and second edges of said internal heat sink, and in which said heat sink is sized and oriented relative to said substrate that said first edges of said substrate and internal heat sink are parallel to and adjacent each other, and said second edges of said substrate and internal heat sink are parallel to and adjacent each other, and said third edges of said substrate and internal heat sink are parallel to and adjacent each other.

4. The film resistor combination as claimed in claim 3, in which said internal heat sink is larger than said substrate, in relationship that said fourth edge of said heat sink is spaced outwardly from said fourth edge of said substrate whereby a substantial portion of said internal heat sink does not underlie said substrate but is instead exposed.

5. The film resistor combination as claimed in claim 2, in which said resistive film is a screen-printed thick film.

6. The film resistor combination as claimed in claim 1, in which said environmentally-protective coating means comprises a screen-printed coating.

7. The film resistor combination as claimed in claim 6, in which said coating is a polymer.

8. The film resistor combination as claimed in claim 6, in which said coating is glass.

9. The film resistor combination as claimed in claim 6, in which said coating is a layer of polymer and a layer of glass, said glass being below said polymer and immediately above said resistive film.

10. The film resistor combination as claimed in claim 1, in which said means to secure said lower surface of said internal heat sink to said flat surface portion of said external heat sink comprises bolt holes in both of said heat sinks, and a bolt extended through said holes.

11. The film resistor combination as claimed in claim 1, in which the lower surface of said internal heat sink has a size and shape such that it substantially entirely fills but does not substantially exceed a rectangle, the size of which is 0.33 inch by 0.45 inch.

12. A power resistor combination, which comprises:

(a) a thin flat ceramic chip having first and second opposed edges that are parallel to each other, and also having third and fourth opposed edges that are parallel to each other and are perpendicular to said first and second edges, said chip having upper and lower sides that are parallel to each other, (b) a resistive film applied to said upper side of said chip, (c) first and second elongate and relatively stiff leads or terminals, first portions of said leads being disposed on said upper side of said chip, adjacent and substantially parallel to said first and second chip edges, respectively, second portions of said leads extending in a predetermined direction away from said chip, said predetermined direction being substantially parallel to said first and second edges of said chip, (d) means to bond said first portions of said leads to said upper side of said chip and in electrically-connected relationship to parts of said resistive film that are respectively relatively adjacent said first and second edges of said chip, (e) a flat metal internal heat sink having upper and lower sides that are parallel to each other, said internal heat sink having first and second opposed edges that are parallel to each other, and third and fourth opposed edges that are parallel to each other and are perpendicular to said first and second edges of said internal heat sink, (f) means to bond said lower side of said chip to said upper side of said internal heat sink in high thermal-conductivity relationship, said bonding means including solder-layer means interposed between said lower side of said chip and said upper side of said internal heat sink, and fused to effect said high thermal-conductivity relationship, said first and second edges of said internal heat sink being substantially parallel to said first and second edges of said chip, (g) thin environmentally-protective coating means provided on said resistive film, (h) an external heat sink having a flat surface portion, and (i) means to secure said lower side of said internal heat sink to said flat surface portion of said external heat sink in high thermal-conductivity relationship, characterized in that there is no molded housing around any part of said chip, and no molded housing around any part of said internal heat sink, and no molded housing around said first portions of said leads, and no molded housing around said environmentally-protective coating means.

13. The power resistor combination as claimed in claim 12, in which said internal heat sink is larger than said chip, in relationship that said fourth edge of said heat sink is spaced outwardly from said fourth edge of said chip whereby a substantial portion of said internal heat sink does not underlie said substrate but is instead exposed.

14. The power resistor combination as claimed in claim 12, in which said resistive film is a screen-printed thick film.

15. The power resistor combination as claimed in claim 12, in which said environmentally-protective coating means comprises a screen-printed coating.

16. The power resistor combination as claimed in claim 15, in which said coating is a polymer.

17. The power resistor combination as claimed in claim 15, in which said coating is glass.

18. The power resistor combination as claimed in claim 15, in which said coating is a layer of polymer and a layer of glass, said glass being below said polymer and immediately above said resistive film.

19. The power resistor combination as claimed in claim 12, in which said means to secure said lower side of said internal heat sink to said flat surface portion of said external heat sink comprises bolt holes in both of said heat sinks, a bolt extended through said holes, a nut on said bolt, and a compression washer between said nut and said external heat sink.

20. The power resistor combination as claimed in claim 12, in which the shape and size of said lower side of said internal heat sink are a rectangle about 0.41 inch long by about 0.64 inch wide.

21. The power resistor combination as claimed in claim 12, in which said means to bond said first portions of said leads to said upper side of said chip comprise metalizations provided on said upper side and extending longitudinally of said leads laterally adjacent said resistive film, and contacting said film, and further comprise solder bonding said first portions of said leads to said metalizations.

22. The power resistor combination as claimed in claim 1, in which said leads have diameters of about 0.03 inch.

23. The power resistor combination as claimed in claim 12, in which said leads have diameters of about 0.03 inch.

* * * * *